United States Patent [19]

Walter et al.

[11] 3,985,414

[45] *Oct. 12, 1976

[54] BUS CLIP AND BUS STRIP CONSTRUCTION

[75] Inventors: Leo Walter, Palos Verdes Peninsula; Helmut W. Greul, Malibu, both of Calif.

[73] Assignee: Electronics Stamping Corporation, Gardena, Calif.

[ * ] Notice: The portion of the term of this patent subsequent to Nov. 11, 1992, has been disclaimed.

[22] Filed: June 13, 1975

[21] Appl. No.: 586,493

Related U.S. Application Data

[63] Continuation-in-part of Ser. No. 503,674, Sept. 6, 1974, Pat. No. 3,918,788.

[52] U.S. Cl. ..... 339/19; 174/72 B; 339/22 B; 339/97 R

[51] Int. Cl.[2] ..... H01R 11/20; H01R 31/08

[58] Field of Search ..... 174/72 B; 339/19, 22 R, 339/22 B, 97 R, 97 P, 98, 99 R

[56] References Cited

UNITED STATES PATENTS

| | | | |
|---|---|---|---|
| 2,997,685 | 8/1961 | Anderson | 339/22 B |
| 3,391,377 | 7/1968 | Corl | 339/99 R |
| 3,526,870 | 9/1970 | Mayala | 339/97 R |
| 3,609,634 | 9/1971 | Hovaniam | 339/19 |
| 3,811,105 | 5/1974 | Gerhard | 339/98 |
| 3,918,788 | 11/1975 | Walter | 339/19 |

OTHER PUBLICATIONS

Malco, Wrapost Jumper Clips Nos. 2612040 & 3610070 Advertisement 1964.

*Primary Examiner*—Roy Lake
*Assistant Examiner*—Mark S. Bicks
*Attorney, Agent, or Firm*—William W. Haefliger

[57] ABSTRACT

A clip operable to connect an electrical terminal post with a bus strip comprises:

a. a channel section having opposed arms between which the bus strip is receivable, b. and a generally hook shaped section integral with one of said arms, said hook shaped section containing an opening to pass said terminal post extending generally parallel to said one arm, c. there being means on the channel section to retain the bus strip in a zone formed by the channel section.

7 Claims, 9 Drawing Figures

BUS CLIP AND BUS STRIP CONSTRUCTION

This application is a continuation-in-part of our copending application Ser. No. 503,674, filed Sept. 6, 1974, now U.S. Pat. No. 3,918,788.

BACKGROUND OF THE INVENTION

This invention relates generally to bus connections to wire wrap terminals, and more particularly concerns the provision of a clip operable to connect a wire wrap post to a bus strip in unusually advantageous manner.

Prior bus connections to wire wrap terminals suffered many inherent disadvantages. These included lack of desired flexibility of selective connection of the post to the bus; bulkiness of the connection; need for new tooling for making different connection progressions along the strip; and lack of ease of assembly, disassembly and reassembly. These disadvantages are further aggravated by bus strips which are insulation covered. To my knowledge, no way was known to overcome these and other disadvantages, prior to the present invention.

SUMMARY OF THE INVENTION

It is a major object of the invention to provide a compact bus clip and bus strip overcoming the above problems and also providing many additional advantages as will appear. Basically, the clip is operable to connect an electrical terminal post to a bus strip, and comprises:

a. a channel section having opposed arms between which the bus strip is receivable, b. and a generally hook shaped section integral with one of said arms, said hook shaped section containing an opening to pass said terminal post extending generally parallel to said one arm, c. there being protuberance means on the channel section to grip and penetrate the bus strip.

As will appear, the arms preferably extend generally upwardly so as to receive the bus strip downwardly therebetween, the protuberance typically forms a tip to penetrate insulation on the bus strip; the bus strip may be of circular cross section and covered by insulation, and one of the arms may be curved to fit the bus strip; the post passing opening is preferably located proximate the top of the hook shaped section, one edge of that opening located in approximate alignment with one of the arms so that the post will extensively contact the latter; also the hook shaped section preferably includes an S-shaped tang having a channel shaped cross section to receive one side of the post in such a way as to confine the post and urge it toward full and effective contact with the arm, as described.

Additional advantages include interlocking of the bus strip and clip to permit release of the clip from the strip as may be desired; and multiple dimples on the strip to interact with clip dimples as will be described.

These and other objects and advantages of the invention as well as the details of an illustrative embodiment will be more fully understood from the following description and drawings, in which:

DRAWING DESCRIPTION

DETAILED DESCRIPTION

Figure 1:
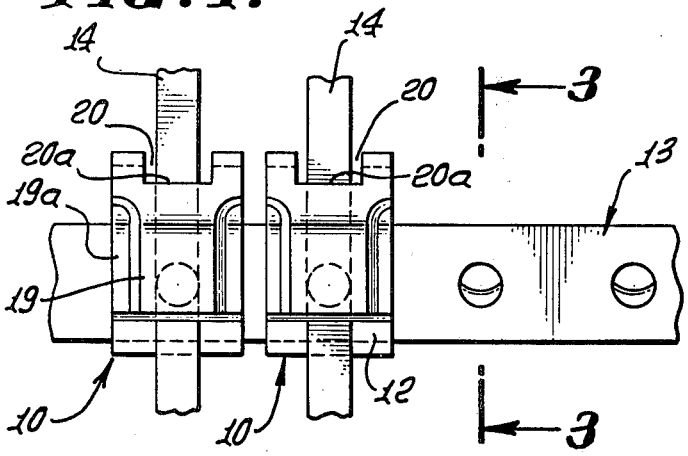
FIG. 1 is a frontal elevation.

In the drawings, the clip 10 as illustrated includes a channel section 10*a* having opposed longitudinally upstanding arms 11 and 12 between which the bus strip 13 is receivable. The latter has a generally rectangular cross section and is vertically elongated, as shown. The clip may with unusual advantage consist of Berillium copper, and be heat treated for strength. Its overall height H is typically less than 0.25 inch, one height dimension of unusual advantage being about 0.130 inch, giving maximum length for wire wrapping on interfitting electrical terminal post 14. Strip 13 may be about 0.025 inch in width and about 0.075 inch in height.

The clip also includes a generally hook-shaped section 10*b* integral with one of the arms, as for example the upper extent 12*a* of arm 12. Section 10*b* extends arcuately upwardly and laterally forwardly at 15 to slightly overhang the space 16′ between arms 11 and 12, then upwardly and laterally rearwardly at 16, then downwardly and laterally rearwardly at 17, then downwardly and laterally forwardly at 18 toward arm 12, and then downwardly and laterally rearwardly at 19 away from arm 12. The arcuate extents 15, 16 and 17 are preferably circularly curved, with outward convexity, and the arcuate extents 18 and 19 have outward concavity. Also, the sections 17, 18 and 19 define a tang with generally S-shape curvature. The tang is resiliently supported by circular curved sections 15 and 16 so as to be resiliently deflected to FIG. 3 condition upon interfitting reception of the post.

Figure 3:
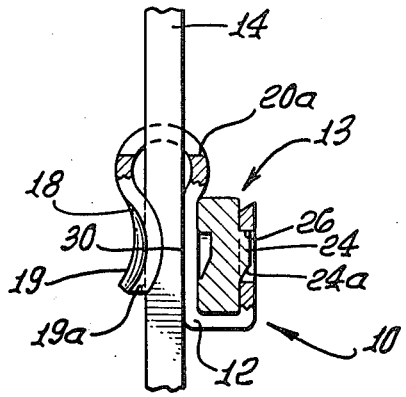
FIG. 3 is a side elevation taken in section on lines 3—3 of FIG. 1.
Figure 4:
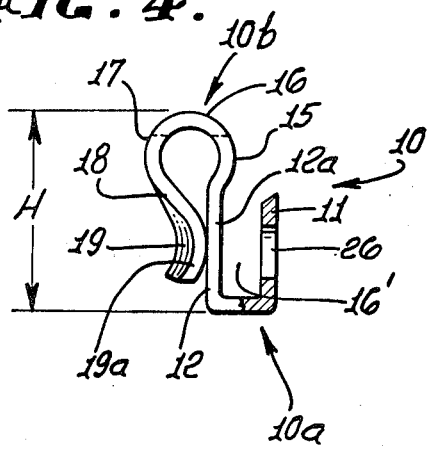
FIG. 4 is a side elevation of the clip shown in FIGS. 1–3.
Figure 5:
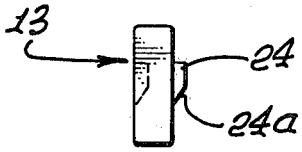
FIG. 5 is a section through the strip seen in FIGS. 1–3.

It will also be noted the hook-shaped section contains a top opening 20 to pass the post, as better seen in FIG. 1. For this purpose a horizontal and downward cut may be made in curved sections 16 and 17, reducing the widths of such sections well below the overall width of the clip, facilitating the resilient support of the S-shaped tang, as described, as by two spaced and curved portions of sections 16 and 17. Note that the forward edge 20*a* of the opening is located in longitudinally vertical alignment with arm 12, as viewed in FIGS. 3 and 4. The S-shaped tang has a channel shaped cross-section at 22 laterally opposite arm 12 to receive one side of the post when the opposite side of the latter engages the arm 12 as also seen in FIG. 3. Note that prior to post insertion, the forward extents 19*a* of the tang lower section 19 extend proximate or engage the rearward side of the arm 12, as is clear from FIG. 4, and the recess 22*a* defined by the channel shaped cross section facilitates endwise guided reception of the post between the tang and the arm 12, and through the opening 20, especially in view of the normally very small size of the clip. Note the full and extensive electrical and mechanical contact between the post and arm at interface 30, the tang urging the post flatly against arm.

Figure 2:
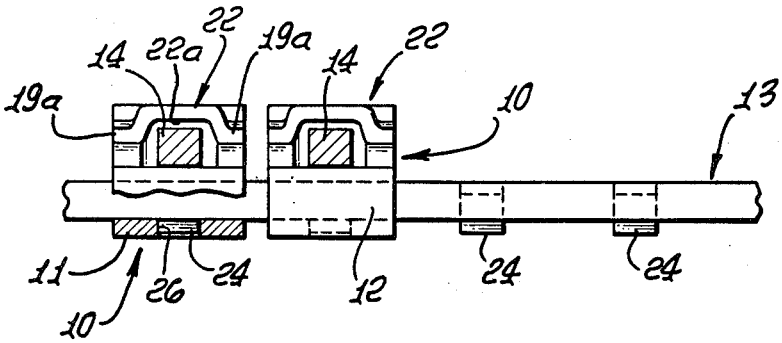
FIG. 2 is a top plan view.

The channel shaped section 10*a* of the clip normally closely receives the bus strip, as seen in FIGS. 1–3, between arms 11 and 12; further, the clip and strip may advantageously have interlocking tongue and groove interfit. For this purpose, a boss or dimple 24 on the strip is receivable into a recess formed by the other arm 11 upon relatively downward reception of the strip into space 16 between the arms 11 and 12. The recess may be defined by a lateral through opening 26 in arm 11, and the boss or dimple on the strip may have a leading edge defining a cam shoulder 24*a* tapered in the downward direction so as to facilitate resilient temporary spreading of arm 11 away from arm 10 as the strip is urged downwardly into space 16. Upon completion of reception of the strip into space 16 as seen in FIG. 3, the boss or dimple is fully received into recess 26, and arm 11 springs back into place. Conversely, arm 11 may be pulled forwardly to release the strip.

Multiple spring clips may be rapidly assembled onto a boss strip as seen in FIGS. 1 and 2, and multiple wire-wrap posts 14 received by such clips. Such posts are preferably polygonal (such as square) in cross section to present edges for making good contact with wire turns wrapped about the posts.

Additional advantages of the strip and clip over known devices include: greater maximum current carrying capacity; minimum overall height; capability for interfit at selected or varying intervals along the strip; capability for quick assembly, disassembly and reassembly by a fabricator to accommodate to his needs; obviates the need for new tooling for each different progression of clips on a bus strip; each part can be separately plated; the strip may be relatively "heavy" to enable carrying greater current for the same loss; the strip can be easily produced with bosses or dimples at varying and selected spacing; the strip 13 can be fabricated from square, round or rectangular cross section stock, or from bare, plated or insulated metal; and the strip can be produced in continuous or selected lengths.

Figure 6:
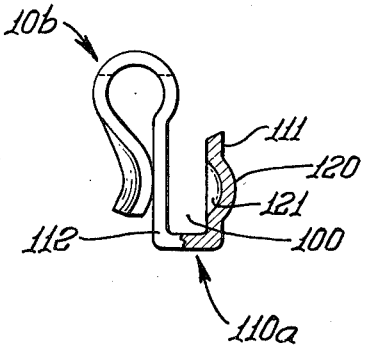
FIG. 6 is a view like FIG. 4 showing a modification.
Figure 7:
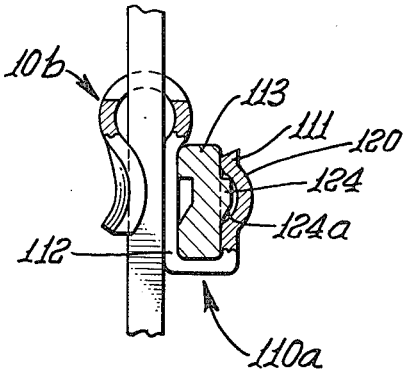
FIG. 7 is a view like FIG. 3 showing a modification.

FIG. 6 shows a modified clip in which channel section 110*a* includes arms 111 and 112 which are upstanding and which define a zone 100 into which the bus strip 113 is receivable, as better seen in FIG. 7. The arm 111 is dimpled at 120 to form a recess 121 for receiving the boss 124 on the strip 113, providing interlocking tongue and groove interfit. Boss 124 has a leading edge defining a cam shoulder 124*a* tapered in a downward direction to facilitate resilient spreading of arm 111 away from arm 112 as the strip is urged downwardly into zone 100. The hook shaped section 10*b* is the same as previously described in FIGS. 3 and 4.

Figure 8:
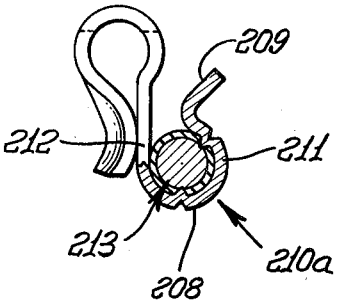
FIG. 8 is a view like FIG. 6 showing another modification.
Figure 9:
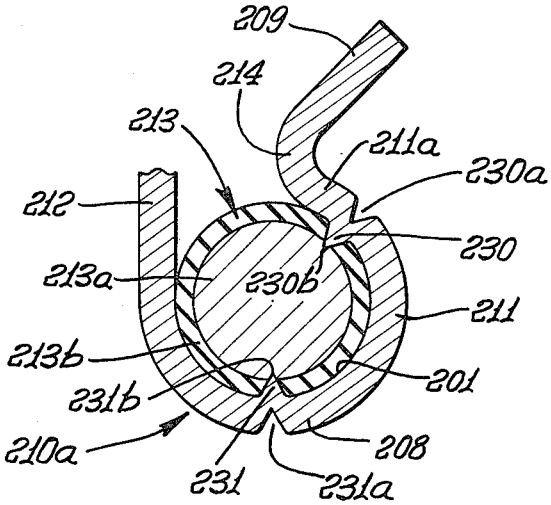
FIG. 9 is an enlarged fragmentary section showing a portion of FIG. 8.

FIGS. 8 and 9 show a still further modified clip in which the channel shaped section 210*a* includes arms 211 and 212 which are upstanding and which define a zone 201 into which the bus strip 213 is receivable. The latter typically includes a circular cross section conductive metallic body 213*a* and an external sheath or layer of insulation 213*b*.

The channel shaped section itself has a generally semi-circular cross section, as provided by the curvature of arm 211 and the curvature of the cross-piece 208 joining arms 211 and 212, whereby the bus strip is closely received or fitted into the channel shaped section, as shown. A guide section 209 is integral at 214 with that upper portion 211*a* of arm 211 which overlaps the upper extent of the bus strip, whereby the bus strip may be initially guided and fitted into the zone 201.

In FIGS. 8 and 9 there is at least one protuberance on the channel-shaped section that defines a tip protruding toward the zone 201 to penetrate into the bus strip upon its close reception in that zone. For example, two protuberances 230 and 231 are shown as formed by inwardly deforming the arm and cross piece at locations 230*a* and 231*a*. The protuberances define pointed tips 230*b* and 231*b* which penetrate through the insulation layer or sheath 213*b* and into the body to provide metal-to-metal contact with the body.

We claim:

1. In a clip operable to connect an electrical terminal post with a bus strip, a. a channel section having generally upwardly extending, laterally spaced and opposed arms forming a zone in which the bus strip is receivable, b. and a generally hook shaped section integral with one of said arms, said hook shaped section including a tang extending downwardly at the lateral side of said one arm opposite the other arm of the channel shaped section, the tang also laterally aligned with said other arm, said hook shaped section containing an opening to pass said terminal post in vertically oriented relation between said tang and said one arm, and c. there being at least one protuberance on said channel shaped section and defining a tip pointed toward said zone to penetrate into the bus strip upon its reception in said zone.

2. The combination that includes the clip of claim 1 and said bus strip closely received in said zone and penetrated by said tip.

3. The combination of claim 2 wherein said bus strip has generally circular cross section and includes a layer of insulation thereon.

4. The combination of claim 1 wherein the channel shaped section has a generally semi-circular cross section.

5. The combination of claim 4 including a second protuberance defining a tip pointed toward said zone, one of the protuberances carried on said other arm, and the other protuberance carried by a portion of the channel shaped section which interconnects the two arms.

6. The combination of claim 4 including a guide section integral with a portion of said other arm which overlaps said zone.

7. In a clip operable to connect an electrical terminal post with a bus strip, a. a channel section having generally upwardly extending, laterally spaced and opposed arms forming a zone in which the bus strip is receivable, b. and a generally hook shaped section integral with one of said arms, said hook shaped section including a tang extending downwardly at the lateral side of said one arm opposite the other arm of the channel shaped section, the tang also laterally aligned with said other arm, said hook shaped section containing an opening to pass said terminal post in vertically oriented relation between said tang and said one arm, and c. and including said bus strip closely received in said zone, there being a boss on the bus strip received in a recess formed by the other of the channel section arms, said other arm being dimpled to form said recess.

* * * * *